US011859882B2

(12) United States Patent
Kaji et al.

(10) Patent No.: US 11,859,882 B2
(45) Date of Patent: Jan. 2, 2024

(54) REFRIGERATION CYCLE APPARATUS

(71) Applicant: DAIKIN INDUSTRIES, LTD., Osaka (JP)

(72) Inventors: Ryuhei Kaji, Osaka (JP); Hirokazu Fujino, Osaka (JP); Kazuhiro Furusho, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/948,410

(22) Filed: Sep. 20, 2022

(65) Prior Publication Data

US 2023/0020557 A1 Jan. 19, 2023

Related U.S. Application Data

(63) Continuation of application No. PCT/JP2021/013115, filed on Mar. 26, 2021.

(30) Foreign Application Priority Data

Mar. 27, 2020 (JP) ..... 2020-058470

(51) Int. Cl.
*F25B 41/20* (2021.01)
*F25B 13/00* (2006.01)

(52) U.S. Cl.
CPC ..... *F25B 41/20* (2021.01); *F25B 13/00* (2013.01)

(58) Field of Classification Search
CPC ..... F25B 41/20; F25B 13/00
See application file for complete search history.

(56) References Cited

U.S. PATENT DOCUMENTS 6,701,722 B1 * 3/2004 Seo ..... F25B 13/00 62/77
2009/0151374 A1 * 6/2009 Kasahara ..... F25B 49/005 62/149

(Continued)

FOREIGN PATENT DOCUMENTS

JP 8-31993 A 2/1996
JP 2002-89980 A 3/2002

(Continued)

OTHER PUBLICATIONS

International Search Report (PCT/ISA/210), issued in PCT/JP2021/013115, dated May 11, 2021.

(Continued)

*Primary Examiner* — Henry T Crenshaw
(74) *Attorney, Agent, or Firm* — Birch, Stewart, Kolasch & Birch, LLP

(57) ABSTRACT

A refrigeration cycle apparatus uses a sensor that measures temperature of a plurality of refrigerant pipes in a contactless manner. A refrigeration cycle apparatus includes a refrigerant circuit in which a compressor, a heat-source-side heat exchanger, an expansion mechanism, and a use-side heat exchanger are connected in sequence. The refrigeration cycle apparatus includes a temperature detector that detects temperatures at a plurality of points in a contactless manner, and a heat-source-side controller. At least one heat-source-side heat exchanger and the use-side heat exchanger includes a plurality of refrigerant pipes through which refrigerant to be heat-exchanged flows, and a flow rate adjuster. The flow rate adjuster adjusts flow rate of the refrigerant flowing through each of the plurality of refrigerant pipes. The temperature detector detects respective temperatures of the plurality of refrigerant pipes. The heat-source-side controller controls the flow rate adjustment unit (Continued)

based on the temperatures detected by the temperature detector.

13 Claims, 6 Drawing Sheets

(56) References Cited

U.S. PATENT DOCUMENTS

| | | | | |
|---|---|---|---|---|
| 2014/0102117 | A1* | 4/2014 | Wayne | F25B 49/02 62/56 |
| 2016/0341497 | A1 | 11/2016 | Kitaguchi | |
| 2017/0268811 | A1* | 9/2017 | Ochiai | F25B 13/00 |
| 2020/0326091 | A1* | 10/2020 | Shin | F24F 1/32 |

FOREIGN PATENT DOCUMENTS

| | | | |
|---|---|---|---|
| JP | 2004-251556 | A | 9/2004 |
| JP | 2005-262989 | A | 9/2005 |
| JP | 2011-94813 | A | 5/2011 |
| JP | 5856531 | B2 | 2/2016 |
| JP | 2017-187155 | A | 10/2017 |
| JP | 2018-151117 | A | 9/2018 |
| JP | 2019-49393 | A | 3/2019 |
| WO | WO 2015/122244 | A1 | 6/2015 |

OTHER PUBLICATIONS

Written Opinion of the International Searching Authority (PCT/ISA/237), issued in PCT/JP2021/013115, dated May 11, 2021.

International Preliminary Report on Patentability and English translation of the Written Opinion of the International Searching Authority for International Application No. PCT/JP2021/013115, dated Oct. 6, 2022.

Extended European Search Report for European Application No. 21775399.5, dated Jul. 6, 2023.

* cited by examiner

| | | | | | | | |
|---|---|---|---|---|---|---|---|
| 0.0 | 0.0 | 0.0 | 0.5 | 1.0 | 2.0 | 3.0 | 3.0 |
| 0.0 | 0.0 | 0.0 | 0.0 | 0.0 | 0.5 | 1.0 | 3.0 |
| 0.0 | 0.0 | 0.0 | 0.0 | 0.0 | 0.0 | 0.5 | 1.0 |
| 0.0 | 0.0 | 0.0 | 0.0 | 0.0 | 0.0 | 1.0 | 2.0 |
| 0.0 | 0.0 | 0.0 | 0.0 | 0.0 | 0.0 | 0.5 | 1.0 |
| 0.0 | 0.0 | 0.0 | 0.0 | 0.0 | 0.0 | 1.0 | 2.0 |
| 0.0 | 0.0 | 0.0 | 0.0 | 0.0 | 0.0 | 0.0 | 1.0 |
| 0.0 | 0.0 | 0.0 | 0.0 | 0.5 | 0.5 | 1.0 | 1.0 |

FIG. 4

REFRIGERATION CYCLE APPARATUS

CROSS REFERENCE TO RELATED APPLICATIONS

This application is a Continuation of PCT International Application No. PCT/JP2021/013115, filed on Mar. 26, 2021, which claims priority under 35 U.S.C. 119(a) to Patent Application No. 2020-058470, filed in Japan on Mar. 27, 2020, all of which are hereby expressly incorporated by reference into the present application.

TECHNICAL FIELD

The present invention relates to a refrigeration cycle apparatus including a heat exchanger.

BACKGROUND ART

PTL 1 (Japanese Unexamined Patent Application Publication No. 2002-89980) discloses a refrigeration cycle apparatus that adjusts the opening degree of a valve disposed in each of a plurality of refrigerant flow paths passing through a heat exchanger in accordance with measurement results of the temperature near the outlets of the refrigerant flow paths.

SUMMARY

A refrigeration cycle apparatus according to a first aspect includes a refrigerant circuit in which a compressor, a heat-source-side heat exchanger, an expansion mechanism, and a use-side heat exchanger are connected in sequence. The refrigeration cycle apparatus includes a temperature detection unit that detects temperatures at a plurality of points in a contactless manner, and a control unit. At least one of the heat-source-side heat exchanger and the use-side heat exchanger includes a plurality of refrigerant pipes through which refrigerant to be heat-exchanged flows, and a flow rate adjustment unit. The flow rate adjustment unit adjusts a flow rate of the refrigerant flowing through each of the plurality of refrigerant pipes. The temperature detection unit detects respective temperatures of the plurality of refrigerant pipes. The control unit controls the flow rate adjustment unit on the basis of the temperatures detected by the temperature detection unit.

BRIEF DESCRIPTION OF DRAWINGS

FIG. 4 illustrates an example of temperature detection data of a detection region R, which is obtained by a temperature detection unit 17.

DESCRIPTION OF EMBODIMENTS (1) Overall Configuration

Figure 1:
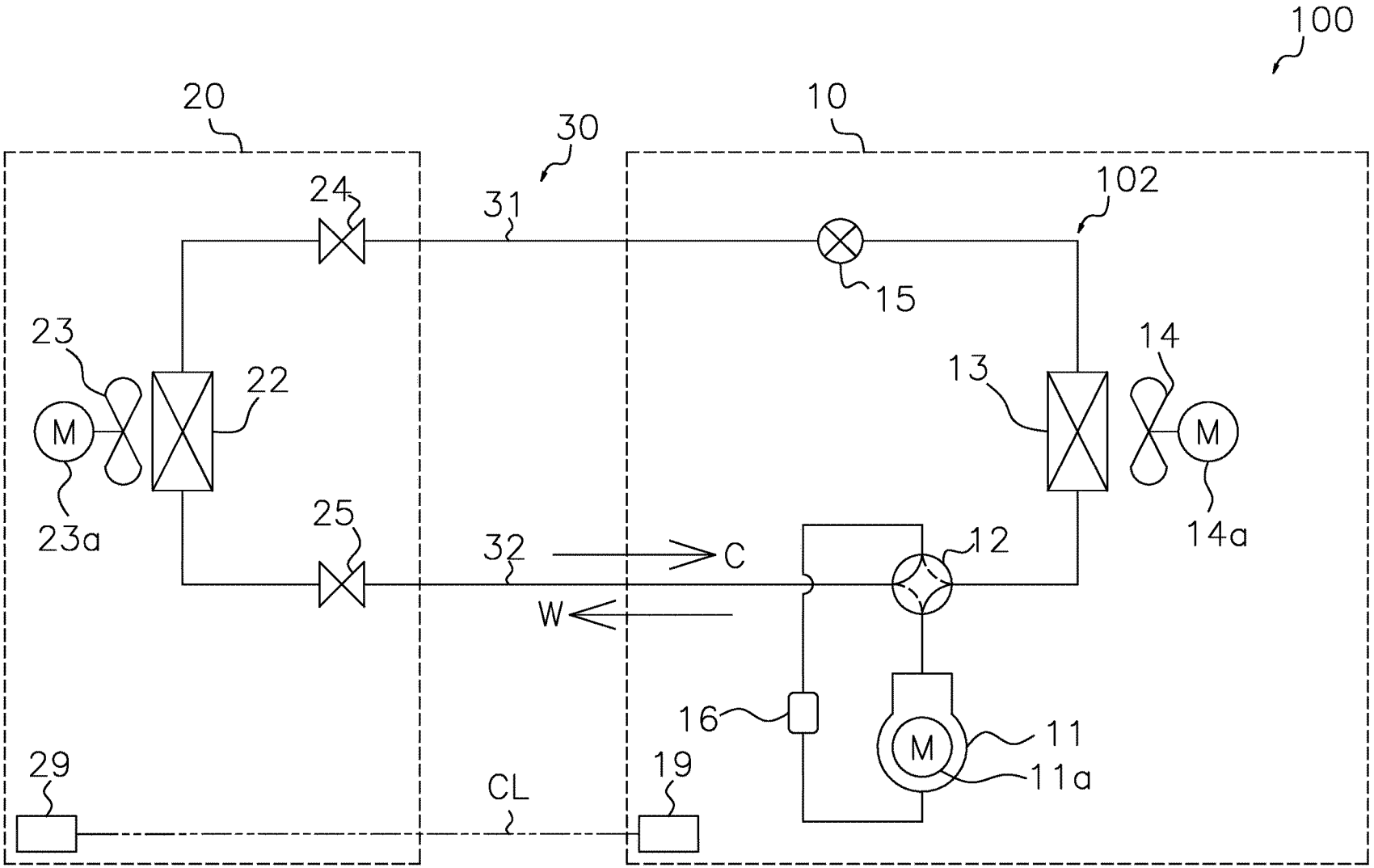
FIG. 1 is a circuit diagram of a refrigeration cycle apparatus 100.

As illustrated in FIG. 1, a refrigeration cycle apparatus 100 mainly includes a heat-source-side unit 10, a use-side unit 20, and a connection pipe 30. The refrigeration cycle apparatus 100 is used as a heat pump apparatus. In this embodiment, the refrigeration cycle apparatus 100 is used as an air conditioning apparatus that performs a cooling operation and a heating operation.

The refrigeration cycle apparatus 100 includes a refrigerant circuit 102 through which refrigerant circulates. In the refrigerant circuit 102, a compressor 11, a heat-source-side heat exchanger 13, an expansion mechanism 15, and a use-side heat exchanger 22 are connected in sequence.

(2) Detailed Configuration (2-1) Heat-Source-Side Unit 10

The heat-source-side unit 10 is a heat pump unit that functions as a heat source. The heat-source-side unit 10 mainly includes the compressor 11, a four-way switching valve 12, the heat-source-side heat exchanger 13, a propeller fan 14, the expansion mechanism 15, an accumulator 16, and a heat-source-side control unit 19.

(2-1-1) Compressor 11

The compressor 11 sucks in and compresses low-pressure gas refrigerant and discharges high-pressure gas refrigerant. The compressor 11 include a compressor motor 11*a*. The compressor motor 11*a* supplies the power required for compressing the refrigerant to the compressor 11.

(2-1-2) Four-Way Switching Valve 12

The four-way switching valve 12 switches the connection state of an internal pipe of the heat-source-side unit 10. In the cooling operation of the refrigeration cycle apparatus 100, the four-way switching valve 12 achieves a connection state indicated by solid lines in FIG. 1. In the heating operation of the refrigeration cycle apparatus 100, the four-way switching valve 12 achieves a connection state indicated by broken lines in FIG. 1.

(2-1-3) Heat-Source-Side Heat Exchanger 13

The heat-source-side heat exchanger 13 has a heat-exchanger body 13*a* that performs heat exchange between the air and the refrigerant circulating through the refrigerant circuit 102.

In the cooling operation of the refrigeration cycle apparatus 100, the heat-exchanger body 13*a* of the heat-source-side heat exchanger 13 functions as a radiator (a condenser). In the heating operation of the refrigeration cycle apparatus 100, the heat-exchanger body 13*a* of the heat-source-side heat exchanger 13 functions as a heat absorber (an evaporator). The details of the heat-source-side heat exchanger 13 will be described below.

(2-1-4) Propeller Fan 14

The propeller fan 14 forms an air flow that promotes heat exchange by the heat-source-side heat exchanger 13. The heat-source-side heat exchanger 13 performs heat exchange between the air in the air flow formed by the propeller fan 14 and the refrigerant. The propeller fan 14 is connected to a propeller fan motor 14*a*. The propeller fan motor 14*a* supplies the power required to operate the propeller fan 14 to the propeller fan 14.

(2-1-5) Expansion Mechanism 15

The expansion mechanism 15 is an electronic expansion valve whose opening degree is adjustable. The expansion mechanism 15 decompresses the refrigerant flowing through the internal pipe of the heat-source-side unit 10. The expansion mechanism 15 controls the flow rate of the refrigerant flowing through the internal pipe of the heat-source-side unit 10.

(2-1-6) Accumulator 16

The accumulator 16 is installed in a pipe on the suction side of the compressor 11. The accumulator 16 separates a gas-liquid refrigerant mixture flowing through the refrigerant circuit 102 into gas refrigerant and liquid refrigerant and stores the liquid refrigerant. The gas refrigerant separated by the accumulator 16 is delivered to a suction port of the compressor 11.

(2-1-7) Heat-Source-Side Control Unit 19

The heat-source-side control unit 19 is a microcomputer including a CPU, a memory, and so on. The heat-source-side control unit 19 controls the compressor motor 11*a*, the four-way switching valve 12, the propeller fan motor 14*a*, the expansion mechanism 15, and so on.

(2-2) Use-Side Unit 20

The use-side unit 20 provides cold heat or hot heat to a user of the refrigeration cycle apparatus 100. The use-side unit 20 mainly includes the use-side heat exchanger 22, a use-side fan 23, a liquid shutoff valve 24, a gas shutoff valve 25, and a use-side control unit 29.

(2-2-1) Use-Side Heat Exchanger 22

The use-side heat exchanger 22 has a heat-exchanger body (not illustrated) that performs heat exchange between the air and the refrigerant circulating through the refrigerant circuit 102.

In the cooling operation of the refrigeration cycle apparatus 100, the heat-exchanger body of the use-side heat exchanger 22 functions as a heat absorber (an evaporator). In the heating operation of the refrigeration cycle apparatus 100, the heat-exchanger body of the use-side heat exchanger 22 functions as a radiator (a condenser).

(2-2-2) Use-Side Fan 23

The use-side fan 23 forms an air flow that promotes heat exchange by the use-side heat exchanger 22. The use-side heat exchanger 22 performs heat exchange between the air in the air flow formed by the use-side fan 23 and the refrigerant. The use-side fan 23 is connected to a use-side fan motor 23*a*. The use-side fan motor 23*a* supplies the power required to operate the use-side fan 23 to the use-side fan 23.

(2-2-3) Liquid Shutoff Valve 24

The liquid shutoff valve 24 is a valve capable of shutting off the refrigerant flow path. The liquid shutoff valve 24 is installed between the use-side heat exchanger 22 and the expansion mechanism 15. The liquid shutoff valve 24 is opened and closed by an operator, for example, at the time of installation or the like of the refrigeration cycle apparatus 100.

(2-2-4) Gas Shutoff Valve 25

The gas shutoff valve 25 is a valve capable of shutting off the refrigerant flow path. The gas shutoff valve 25 is installed between the use-side heat exchanger 22 and the four-way switching valve 12. The gas shutoff valve 25 is opened and closed by an operator, for example, at the time of installation or the like of the refrigeration cycle apparatus 100.

(2-2-5) Use-Side Control Unit 29

The use-side control unit 29 is a microcomputer including a CPU, a memory, and so on. The use-side control unit 29 controls the use-side fan motor 23*a* and so on.

The use-side control unit 29 transmits and receives data and commands to and from the heat-source-side control unit 19 via a communication line CL.

(2-3) Connection Pipe 30

The connection pipe 30 guides the refrigerant moving between the heat-source-side unit 10 and the use-side unit 20. The connection pipe 30 includes a liquid connection pipe 31 and a gas connection pipe 32.

(2-3-1) Liquid Connection Pipe 31

The liquid connection pipe 31 mainly guides liquid refrigerant or gas-liquid two-phase refrigerant. The liquid connection pipe 31 connects the liquid shutoff valve 24 and the heat-source-side unit 10 to each other.

(2-3-2) Gas Connection Pipe 32

The gas connection pipe 32 mainly guides gas refrigerant. The gas connection pipe 32 connects the gas shutoff valve 25 and the heat-source-side unit 10 to each other.

(3) Overall Operation

The refrigerant used in the refrigeration cycle apparatus 100 undergoes a change accompanied by a phase transition, such as condensation or evaporation, in the heat-source-side heat exchanger 13 and the use-side heat exchanger 22. However, the refrigerant may not necessarily undergo a change accompanied by phase transition in the heat-source-side heat exchanger 13 and the use-side heat exchanger 22.

(3-1) Cooling Operation

In the cooling operation of the refrigeration cycle apparatus 100, the refrigerant circulates in a first direction indicated by an arrow C in FIG. 1. In this case, the heat-exchanger body 13*a* of the heat-source-side heat exchanger 13 and the heat-exchanger body of the use-side heat exchanger 22 function as a radiator and a heat absorber, respectively.

The high-pressure gas refrigerant discharged from the compressor 11 passes through the four-way switching valve 12 and reaches the heat-source-side heat exchanger 13. In the heat-source-side heat exchanger 13, the high-pressure gas refrigerant exchanges heat with the air, condenses, and changes to high-pressure liquid refrigerant. Thereafter, the high-pressure liquid refrigerant reaches the expansion mechanism 15. In the expansion mechanism 15, the high-pressure liquid refrigerant is decompressed into low-pressure gas-liquid two-phase refrigerant. Thereafter, the low-pressure gas-liquid two-phase refrigerant passes through the liquid connection pipe 31 and the liquid shutoff valve 24 and reaches the use-side heat exchanger 22. In the use-side heat exchanger 22, the low-pressure gas-liquid two-phase refrigerant exchanges heat with the air, evaporates, and changes to low-pressure gas refrigerant. In this process, the temperature of the air in the space where the user is located is decreased. Thereafter, the low-pressure gas refrigerant passes through the gas shutoff valve 25, the gas connection pipe 32, the four-way switching valve 12, and the accumulator 16 and reaches the compressor 11. Thereafter, the compressor 11 sucks in the low-pressure gas refrigerant.

(3-2) Heating Operation

In the heating operation of the refrigeration cycle apparatus 100, the refrigerant circulates in a second direction indicated by an arrow W in FIG. 1. In this case, the heat-exchanger body 13*a* of the heat-source-side heat exchanger 13 and the heat-exchanger body of the use-side heat exchanger 22 function as a heat absorber and a radiator, respectively.

The high-pressure gas refrigerant discharged from the compressor 11 passes through the four-way switching valve 12, the gas connection pipe 32, and the gas shutoff valve 25 and reaches the use-side heat exchanger 22. In the use-side heat exchanger 22, the high-pressure gas refrigerant exchanges heat with the air, condenses, and changes to high-pressure liquid refrigerant. In this process, the temperature of the air in the space where the user is located is increased. Thereafter, the high-pressure liquid refrigerant passes through the liquid shutoff valve 24 and the liquid connection pipe 31 and reaches the expansion mechanism 15. In the expansion mechanism 15, the high-pressure liquid refrigerant is decompressed into low-pressure gas-liquid two-phase refrigerant. Thereafter, the low-pressure gas-liquid two-phase refrigerant reaches the heat-source-side heat exchanger 13. In the heat-source-side heat exchanger 13, the low-pressure gas-liquid two-phase refrigerant exchanges heat with the air, evaporates, and changes to low-pressure gas refrigerant. Thereafter, the low-pressure gas refrigerant passes through the four-way switching valve 12 and the accumulator 16 and reaches the compressor 11. Thereafter, the compressor 11 sucks in the low-pressure gas refrigerant.

(4) Detailed Configuration of Heat-Source-Side Heat Exchanger 13

Figure 2:
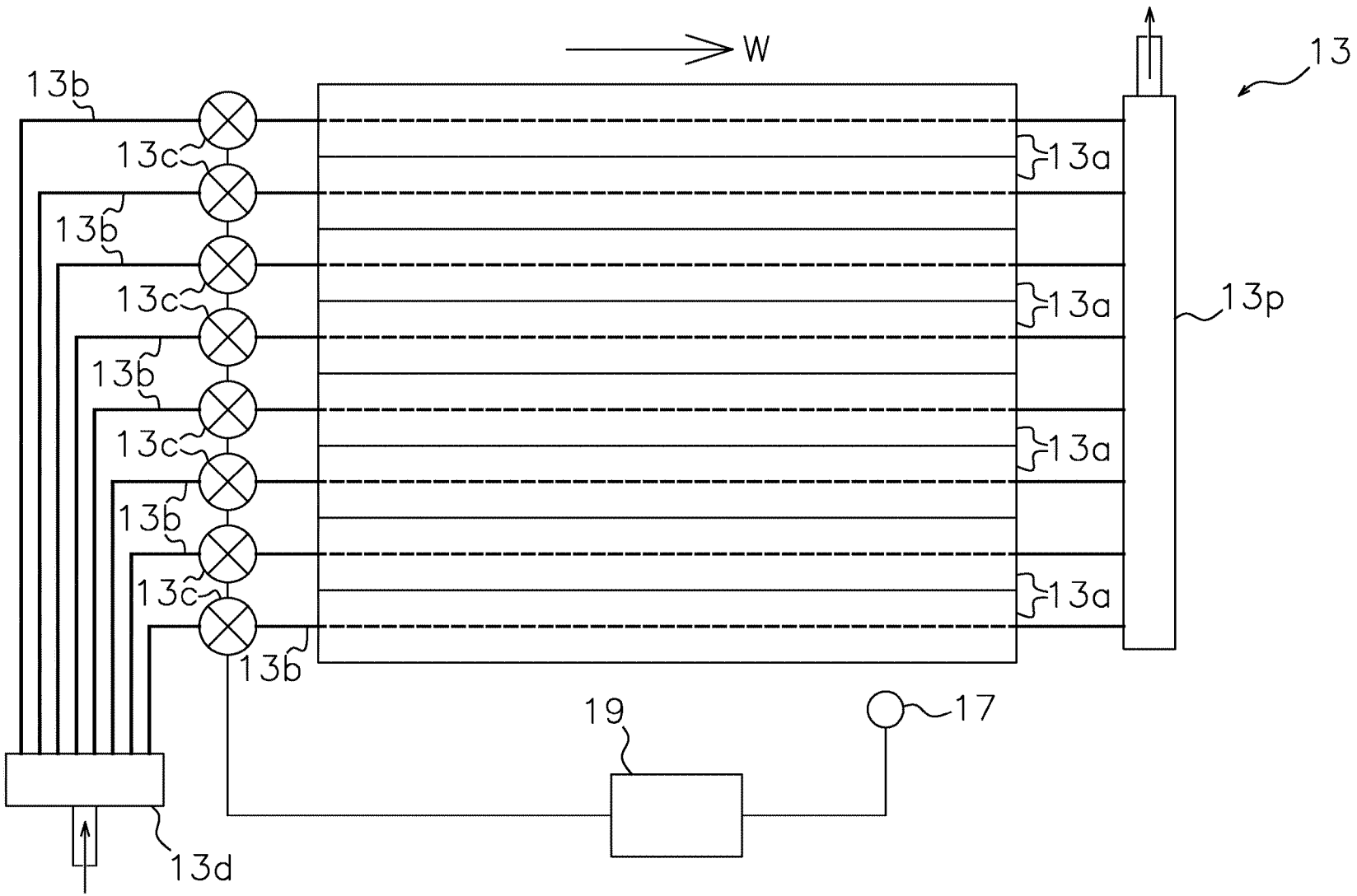
FIG. 2 is a detailed circuit diagram of the refrigeration cycle apparatus 100 in the vicinity of a heat-source-side heat exchanger 13.

As illustrated in FIG. 2, the heat-source-side heat exchanger 13 includes a plurality of heat-exchanger bodies 13*a*, a plurality of refrigerant pipes 13*b*, one branch unit 13*d*, and one temperature detection unit 17. The refrigerant pipes 13*b* pass through the heat-exchanger bodies 13*a*. Each of the refrigerant pipes 13*b* passes through a corresponding one of the heat-exchanger bodies 13*a*. The refrigerant pipes 13*b* are each a pipe through which the refrigerant to be heat-exchanged in the corresponding one of the heat-exchanger bodies 13*a* flows.

The branch unit 13*d* branches the flow of the refrigerant in the refrigerant circuit 102, which is directed toward the heat-exchanger bodies 13*a*, into the plurality of refrigerant pipes 13*b*. In the heating operation of the refrigeration cycle apparatus 100, the refrigerant flows in a second direction indicated by an arrow W in FIG. 2. The branch unit 13*d* distributes the refrigerant directed toward the heat-exchanger bodies 13*a* (the refrigerant flowing in the second direction) to the plurality of refrigerant pipes 13*b*. To this end, the branch unit 13*d* is disposed between the expansion mechanism 15 and the heat-exchanger bodies 13*a*. As illustrated in FIG. 2, in the heating operation, the flows of refrigerant distributed to the refrigerant pipes 13*b* and heat-exchanged in the heat-exchanger bodies 13*a* are joined together in a header 13*p*, and the joint flow of the refrigerant is delivered to the refrigerant circuit 102.

At least one of the plurality of refrigerant pipes 13*b* includes a flow rate adjustment unit 13*c*. As illustrated in FIG. 2, in this embodiment, each of the plurality of refrigerant pipes 13*b* includes one flow rate adjustment unit 13*c*. In other words, the number of flow rate adjustment units 13*c* is the same as the number of refrigerant pipes 13*b*. The flow rate adjustment units 13*c* are attached to the refrigerant pipes 13*b*, for example. The flow rate adjustment units 13*c* are disposed between the expansion mechanism 15 and the heat-exchanger bodies 13*a*. Specifically, the flow rate adjustment units 13*c* are disposed between the branch unit 13*d* and the heat-exchanger bodies 13*a*.

The flow rate adjustment units 13*c* are each a mechanism for adjusting the flow rate of the refrigerant flowing through the inside of the corresponding one of the refrigerant pipes 13*b*. Specifically, each of the flow rate adjustment units 13*c* includes an electromagnetic valve whose opening degree is adjustable. The flow rate adjustment units 13*c* are capable of increasing or decreasing the flow rates of the refrigerant flowing through the inside of the corresponding refrigerant pipes 13*b* in accordance with the opening degrees of the electromagnetic valves.

Figure 3:
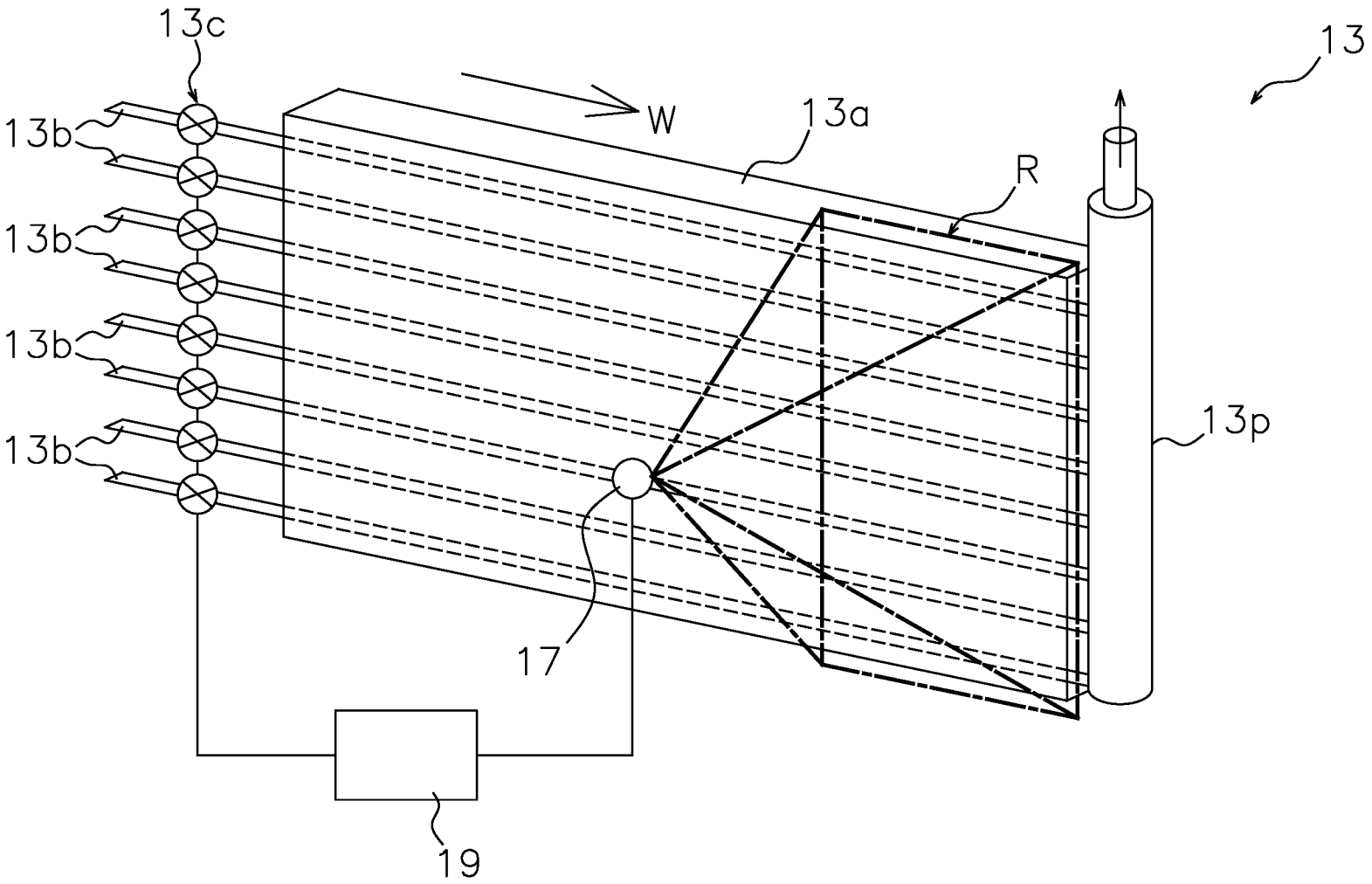
FIG. 3 is a schematic diagram of the refrigeration cycle apparatus 100 in the vicinity of the heat-source-side heat exchanger 13.

The temperature detection unit 17 detects temperatures at a plurality of points in a contactless manner. Specifically, the temperature detection unit 17 detects the respective surface temperatures of the plurality of refrigerant pipes 13*b* in a contactless manner. As illustrated in FIG. 3, the temperature detection unit 17 is an array sensor that detects in a contactless manner a temperature distribution in a predetermined detection region R, which is a two-dimensional plane. The array sensor is, for example, a radiation thermometer that measures the intensity of infrared or visible light emitted from an object to measure the temperature of the object. As illustrated in FIG. 3, the temperature detection unit 17 performs a surface measurement of the surface temperature near the outlet of each of the plurality of refrigerant pipes 13*b*. The outlets of the refrigerant pipes 13*b* are ends of the refrigerant pipes 13*b* closer to the header 13*p*.

As illustrated in FIG. 2 and FIG. 3, the heat-source-side control unit 19 is connected to the temperature detection unit 17 and the flow rate adjustment units 13*c*. The heat-source-side control unit 19 automatically adjusts the opening degrees of the electromagnetic valves of the flow rate adjustment units 13*c* on the basis of data related to the temperatures detected by the temperature detection unit 17. The data related to the temperatures detected by the temperature detection unit 17 is, as illustrated in FIG. 4, temperatures at respective points in the detection region R. In FIG. 4, temperature detection points are arranged in a matrix, and the temperature of each point is represented by a numerical value.

The heat-source-side control unit 19 controls the flow rate adjustment units 13*c* on the basis of the temperatures detected by the temperature detection unit 17. Specifically, the heat-source-side control unit 19 adjusts the opening degrees of the electromagnetic valves of the respective flow rate adjustment units 13*c* on the basis of the data illustrated in FIG. 4 to control the flow rates of the refrigerant flowing through the inside of the corresponding refrigerant pipes 13*b*. The heat-source-side control unit 19 controls the opening degrees of the electromagnetic valves of the flow rate adjustment units 13*c* so that the flow rate of the refrigerant flowing through a refrigerant pipe 13*b* having a relatively high temperature among the plurality of refrigerant pipes 13*b* increases or the flow rate of the refrigerant flowing through a refrigerant pipe 13*b* having a relatively low temperature among the plurality of refrigerant pipes 13*b* decreases. Accordingly, the heat-source-side control unit 19 can reduce the differences in surface temperature between the plurality of refrigerant pipes 13*b*.

(5) Features

The refrigeration cycle apparatus 100 includes the temperature detection unit 17 that performs a surface measurement of the temperature of the heat-source-side heat exchanger 13 in a contactless manner. The temperature detection unit 17 detects the surface temperatures near the outlets of the refrigerant pipes 13*b* of the heat-source-side heat exchanger 13. The heat-source-side control unit 19 predicts the flow rates of the refrigerant in the refrigerant pipes 13*b* on the basis of the detected temperatures and controls the opening degrees of the electromagnetic valves of the flow rate adjustment units 13*c* attached to the corresponding refrigerant pipes 13*b*.

The heat-source-side control unit 19 controls the opening degrees of the electromagnetic valves so that, for example, the surface temperatures near the outlets of the refrigerant pipes 13*b* become uniform. Specifically, the heat-source-side control unit 19 controls the opening degrees of the electromagnetic valves so that the temperatures detected by the temperature detection unit 17 in the detection region R are as uniform as possible. Accordingly, during the heating operation, the low-pressure gas-liquid two-phase refrigerant that has passed through the expansion mechanism 15 is likely to be equally divided into flows to the plurality of refrigerant pipes 13*b* by the branch unit 13*d*. In other words, the flow rates of the refrigerant in the refrigerant pipes 13*b* are equal. Accordingly, the heat-source-side control unit 19 can suppress the uneven flow of the refrigerant during the heating operation, and a reduction in the performance of the refrigeration cycle apparatus 100 is suppressed.

The measurement of the surface temperatures of the refrigerant pipes 13*b* using contact-type temperature sensors requires a temperature sensor that is attached to the surface of each of the refrigerant pipes 13*b*. When contact-type temperature sensors are used, an increase in the number of refrigerant pipes 13*b* increases the number of required temperature sensors, resulting in an increase in cost. However, the refrigeration cycle apparatus 100, which is configured to perform a surface measurement of the surface temperatures of the refrigerant pipes 13*b* in a contactless manner using the temperature detection unit 17, can reduce the number of temperature sensors and the number of input/output ports of an electric component, and can reduce cost.

In the refrigeration cycle apparatus 100, furthermore, the temperature detection unit 17 can be used to monitor the surface temperature of the heat-source-side heat exchanger 13 (the surface temperatures of the plurality of refrigerant pipes 13*b*) in a wide range. Accordingly, the heat-source-side control unit 19 can detect, based on detection data obtained by the temperature detection unit 17, a decrease in the surface temperature of any of the refrigerant pipes 13*b* due to the leakage of the refrigerant from the refrigerant pipe 13*b*. As described above, in the refrigeration cycle apparatus 100, the temperature detection unit 17 and the heat-source-side control unit 19 can be used to identify a failure caused in any of the refrigerant pipes 13*b*.

(6) Modifications (6-1) Modification A

Like the heat-source-side heat exchanger 13 according to the embodiment, the use-side heat exchanger 22 may include a plurality of heat-exchanger bodies. In this case, like the heat-source-side heat exchanger 13 according to the embodiment, the use-side heat exchanger 22 may further include a plurality of refrigerant pipes that pass through the heat-exchanger bodies, a branch unit that divides the refrigerant into flows to the plurality of refrigerant pipes, flow rate adjustment units attached to the respective refrigerant pipes, and a temperature detection unit. In other words, the use-side heat exchanger 22 may have a configuration and functions similar to those of the heat-source-side heat exchanger 13 illustrated in FIG. 2 and FIG. 3. In this case, the use-side control unit 29 controls the flow rate adjustment units of the refrigerant pipes on the basis of the temperatures of the refrigerant pipes, which are detected by the temperature detection unit of the use-side heat exchanger 22 in a contactless manner.

In this modification, only the use-side heat exchanger 22 may include a plurality of heat-exchanger bodies, or both the heat-source-side heat exchanger 13 and the use-side heat exchanger 22 may include a plurality of heat-exchanger bodies. In this case, a heat exchanger including a plurality of heat-exchanger bodies may have a configuration and functions similar to those of the heat-source-side heat exchanger 13 illustrated in FIG. 2 and FIG. 3.

This modification is also applicable to other modifications.

(6-2) Modification B

The embodiment relates to control of the heat-source-side control unit 19 in a case where the heat-source-side heat exchanger 13 functions as a heat absorber. However, when the heat-source-side heat exchanger 13 functions as a radiator, the heat-source-side control unit 19 may perform control different from that in the embodiment. Specifically, the heat-source-side control unit 19 may control the flow rate adjustment units 13*c* so that the flow rate of the refrigerant flowing through a refrigerant pipe 13*b* having a relatively high temperature among the plurality of refrigerant pipes 13*b* decreases or the flow rate of the refrigerant flowing through a refrigerant pipe 13*b* having a relatively low temperature among the plurality of refrigerant pipes 13*b* increases.

(6-3) Modification C

Figure 5:
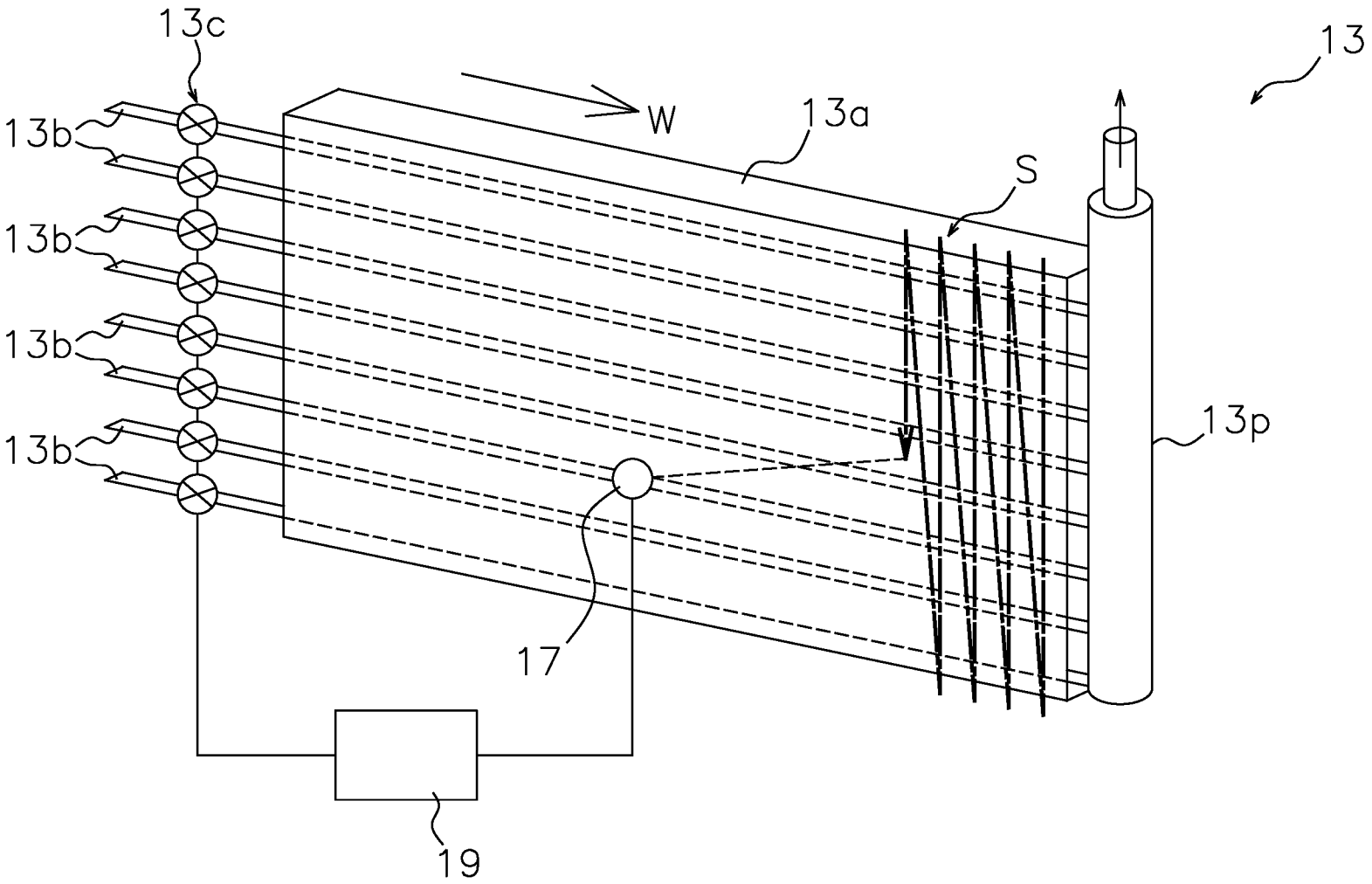
FIG. 5 is a schematic diagram of the refrigeration cycle apparatus 100 in the vicinity of the heat-source-side heat exchanger 13 in Modification C.
Figure 6:
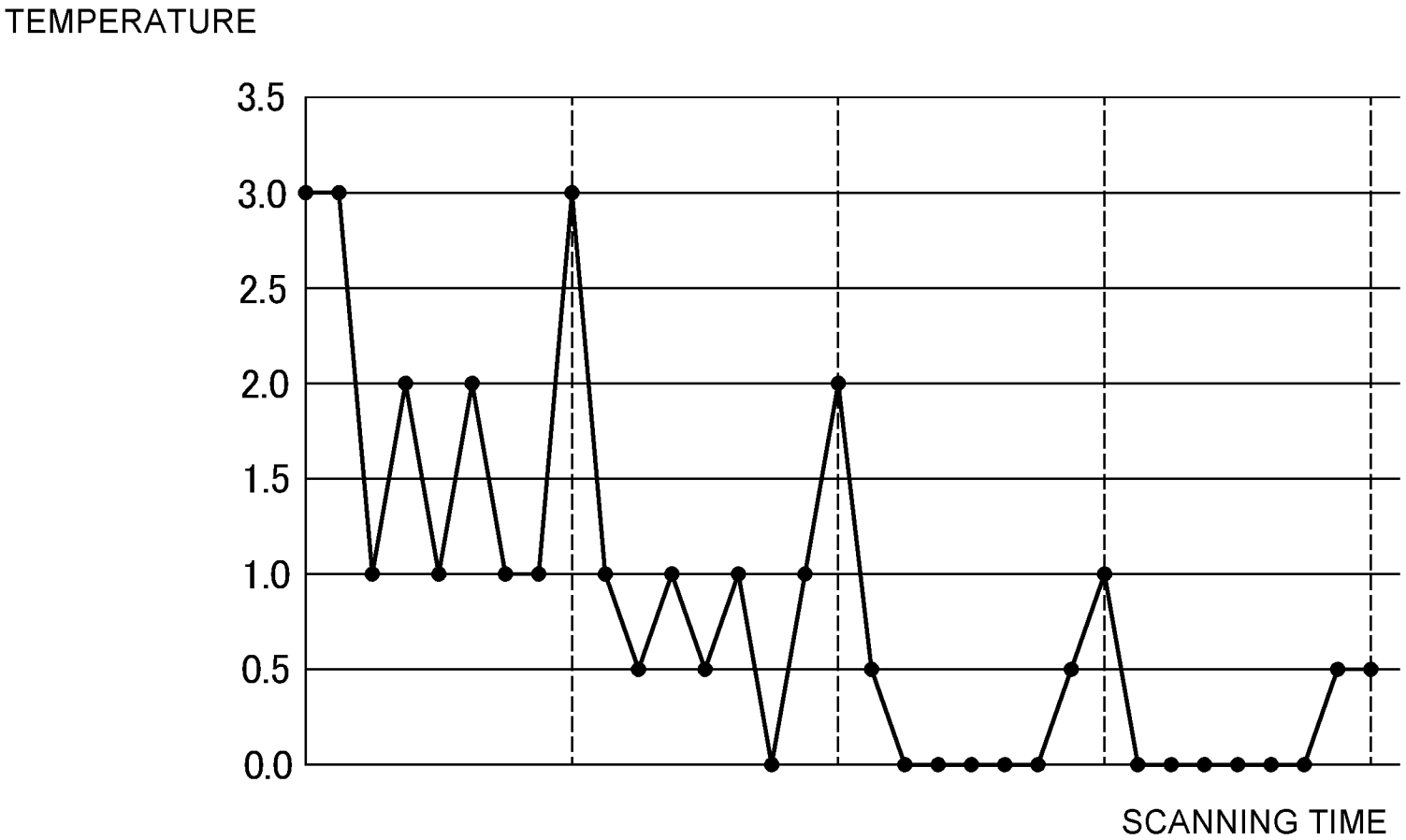
FIG. 6 illustrates an example of measurement data obtained by scanning with a single sensor in Modification C.

The temperature detection unit 17 may detect the respective temperatures of the plurality of refrigerant pipes 13*b* by performing a line measurement while scanning with a single sensor. In this case, the temperature detection unit 17 scans a predetermined detection region of the heat-source-side heat exchanger 13 along a predetermined path using a contactless temperature sensor to detect the surface temperatures of the plurality of refrigerant pipes 13*b*. FIG. 5 illustrates an example of a scanning path S of the single sensor. FIG. 6 illustrates an example of measurement data obtained by scanning with the single sensor. In FIG. 6, the horizontal axis represents the scanning time, and the vertical axis represents the detected temperature. The data illustrated in FIG. 6 corresponds to a linear expansion of the matrix data illustrated in FIG. 4 from the right side (the side of the header 13*p*) to the left side (the side of the flow rate adjustment units 13*c*) as illustrated in FIG. 5.

(6-4) Modification D

In the heat-source-side heat exchanger 13, the number of flow rate adjustment units 13*c* may be smaller than the number of refrigerant pipes 13*b* by 1. In this case, the heat-source-side heat exchanger 13 includes one refrigerant pipe 13*b* that does not include a flow rate adjustment unit 13*c*. The flow resistance of the refrigerant pipe 13*b* that does not include a flow rate adjustment unit 13*c* can be adjusted by the design of the flow rate adjustment units 13*c* of the other refrigerant pipes 13*b*, for example.

(6-5) Modification E

The heat-source-side heat exchanger 13 may include a plurality of branch units 13*d*. In this case, the flow resistances, the flow rates, and the like of the refrigerant passing through the refrigerant pipes 13*b* can be adjusted to some extent in accordance with the state of connection between the branch units 13*d* and the pipes.

—Note—

While an embodiment of the present disclosure has been described, it will be understood that forms and details can be changed in various ways without departing from the spirit and scope of the present disclosure as recited in the claims.

REFERENCE SIGNS LIST

11 compressor
13 heat-source-side heat exchanger
13*b* refrigerant pipe
13*c* flow rate adjustment unit
15 expansion mechanism
17 temperature detection unit
19 heat-source-side control unit (control unit)
22 use-side heat exchanger
100 refrigeration cycle apparatus
102 refrigerant circuit

CITATION LIST

Patent Literature

<PTL 1> Japanese Unexamined Patent Application Publication No. 2002-89980

The invention claimed is:

1. A refrigeration cycle apparatus including a refrigerant circuit in which a compressor, a heat-source-side heat exchanger, an expansion mechanism, and a use-side heat exchanger are connected in sequence, the refrigeration cycle apparatus comprising:

a temperature detector, including at least one radiation thermometer that measures an intensity of infrared or visible light emitted from a surface, that detects temperatures at a plurality of points in a contactless manner; and a controller, wherein at least one of the heat-source-side heat exchanger and the use-side heat exchanger includes a plurality of refrigerant pipes through which refrigerant to be heat-exchanged flows, a branch unit in which the flow of the refrigerant to be heat-exchanged is distributed to the plurality of refrigerant pipes, a flow rate adjustment unit including a valve capable of adjusting a flow rate of the refrigerant flowing through each of the plurality of refrigerant pipes, and a header in which the flows of the refrigerant distributed to the plurality of refrigerant pipes and heat-exchanged in the heat-source-side heat exchanger are joined together, the temperature detector detects, for each of the plurality of refrigerant pipes, surface temperatures at a plurality of points near an outlet of a respective refrigerant pipe, the controller controls the flow rate adjustment unit on the basis of the temperatures detected by the temperature detector so that the surface temperatures near the outlets of the plurality of refrigerant pipes become uniform, and the controller detects, on the basis of the temperatures detected at the plurality of points along a respective refrigerant pipe by the temperature detector, a decrease in the surface temperatures of the refrigerant pipes due to leakage of refrigerant from the refrigerant pipes, to identify a failure caused in the respective refrigerant pipes.

2. The refrigeration cycle apparatus according to claim 1, wherein the flow rate adjuster includes the valve whose opening degree is adjustable, the valve being disposed in at least one of the plurality of refrigerant pipes, and the controller adjusts the opening degree of each valve on the basis of the temperatures detected by the temperature detector.

3. The refrigeration cycle apparatus according to claim 1, wherein the temperature detector detects the temperatures of the plurality of refrigerant pipes by performing a surface measurement using an array sensor.

4. The refrigeration cycle apparatus according to claim 1, wherein the temperature detector detects the temperatures of the plurality of refrigerant pipes by performing a line measurement while scanning with a single sensor.

5. The refrigeration cycle apparatus according to claim 1, wherein the controller controls the flow rate adjuster so that, when the heat-source-side heat exchanger or the use-side heat exchanger functions as a heat absorber, the flow rate of the refrigerant flowing through a pipe having a relatively high temperature among the plurality of refrigerant pipes increases or the flow rate of the refrigerant flowing through a pipe having a relatively low temperature among the plurality of refrigerant pipes decreases, and controls the flow rate adjuster so that, when the heat-source-side heat exchanger or the use-side heat exchanger functions as a radiator, the flow rate of the refrigerant flowing through a pipe having a relatively high temperature among the plurality of refrigerant pipes decreases or the flow rate of the refrigerant flowing through a pipe having a relatively low temperature among the plurality of refrigerant pipes increases.

6. The refrigeration cycle apparatus according to claim 2, wherein the temperature detector detects the temperatures of the plurality of refrigerant pipes by performing a surface measurement using an array sensor.

7. The refrigeration cycle apparatus according to claim 2, wherein the temperature detector detects the temperatures of the plurality of refrigerant pipes by performing a line measurement while scanning with a single sensor.

8. The refrigeration cycle apparatus according to claim 2, wherein the temperature detector measures respective surface temperatures of the plurality of refrigerant pipes.

9. The refrigeration cycle apparatus according to claim 3, wherein the temperature detector measures respective surface temperatures of the plurality of refrigerant pipes.

10. The refrigeration cycle apparatus according to claim 4, wherein the temperature detector measures respective surface temperatures of the plurality of refrigerant pipes.

11. The refrigeration cycle apparatus according to claim 2, wherein the controller controls the flow rate adjuster so that, when the heat-source-side heat exchanger or the use-side heat exchanger functions as a heat absorber, the flow rate of the refrigerant flowing through a pipe having a relatively high temperature among the plurality of refrigerant pipes increases or the flow rate of the refrigerant flowing through a pipe having a relatively low temperature among the plurality of refrigerant pipes decreases, and controls the flow rate adjuster so that, when the heat-source-side heat exchanger or the use-side heat exchanger functions as a radiator, the flow rate of the refrigerant flowing through a pipe having a relatively high temperature among the plurality of refrigerant pipes decreases or the flow rate of the refrigerant flowing through a pipe having a relatively low temperature among the plurality of refrigerant pipes increases.

12. The refrigeration cycle apparatus according to claim 3, wherein the controller controls the flow rate adjuster so that, when the heat-source-side heat exchanger or the use-side heat exchanger functions as a heat absorber, the flow rate of the refrigerant flowing through a pipe having a relatively high temperature among the plurality of refrigerant pipes increases or the flow rate of the refrigerant flowing through a pipe having a relatively low temperature among the plurality of refrigerant pipes decreases, and controls the flow rate adjuster so that, when the heat-source-side heat exchanger or the use-side heat exchanger functions as a radiator, the flow rate of the refrigerant flowing through a pipe having a relatively high temperature among the plurality of refrigerant pipes decreases or the flow rate of the refrigerant flowing through a pipe having a relatively low temperature among the plurality of refrigerant pipes increases.

13. The refrigeration cycle apparatus according to claim 4, wherein the controller controls the flow rate adjuster so that, when the heat-source-side heat exchanger or the use-side heat exchanger functions as a heat absorber, the flow rate of the refrigerant flowing through a pipe having a relatively high temperature among the plurality of refrigerant pipes increases or the flow rate of the refrigerant flowing through a pipe having a relatively low temperature among the plurality of refrigerant pipes decreases, and controls the flow rate adjuster so that, when the heat-source-side heat exchanger or the use-side heat exchanger functions as a radiator, the flow rate of the refrigerant flowing through a pipe having a relatively high temperature among the plurality of refrigerant pipes decreases or the flow rate of the refrigerant flowing through a pipe having a relatively low temperature among the plurality of refrigerant pipes increases.

* * * * *